United States Patent [19]

Hall

[11] Patent Number: 4,707,051

[45] Date of Patent: Nov. 17, 1987

[54] TAP CONNECTOR

[76] Inventor: Gaddis G. Hall, P.O. Box 835, Trussville, Ala. 35173

[21] Appl. No.: 901,423

[22] Filed: Aug. 28, 1986

[51] Int. Cl.[4] ..... H01R 4/44

[52] U.S. Cl. ..... 439/781; 439/815

[58] Field of Search ..... 339/246, 263 R, 272 R, 339/273 R, 273 S, 265 R, 270 R, 263 L, 266 R, 266 G, 266 L

[56] References Cited

U.S. PATENT DOCUMENTS

| | | | |
|---|---|---|---|
| 2,534,970 | 12/1950 | Hausman | 339/273 R |
| 2,651,766 | 9/1953 | Runde | 339/246 |
| 2,712,167 | 7/1955 | Blanchard | 339/246 |
| 3,399,375 | 8/1968 | Peek | 339/246 |

FOREIGN PATENT DOCUMENTS

| | | | |
|---|---|---|---|
| 964114 | 1/1950 | France | 339/246 |
| 1309042 | 12/1961 | France | 339/246 |

*Primary Examiner*—Gil Weidenfeld
*Assistant Examiner*—Daniel W. Howell
*Attorney, Agent, or Firm*—Jennings, Carter, Thompson & Veal

[57] ABSTRACT

A three part connector for use in connecting tap lines to energized main lines uses a plurality of fasteners to secure a tap line keeper and cap member to a body member. The fasteners are peened to prevent their inadvertent removal from the connector, thus facilitating the use of the connector. The tap line keeper may be independently used to secure the tap line to the connector to prevent unexpected tap line disconnection during the tapping process.

22 Claims, 7 Drawing Figures

FIG. 1
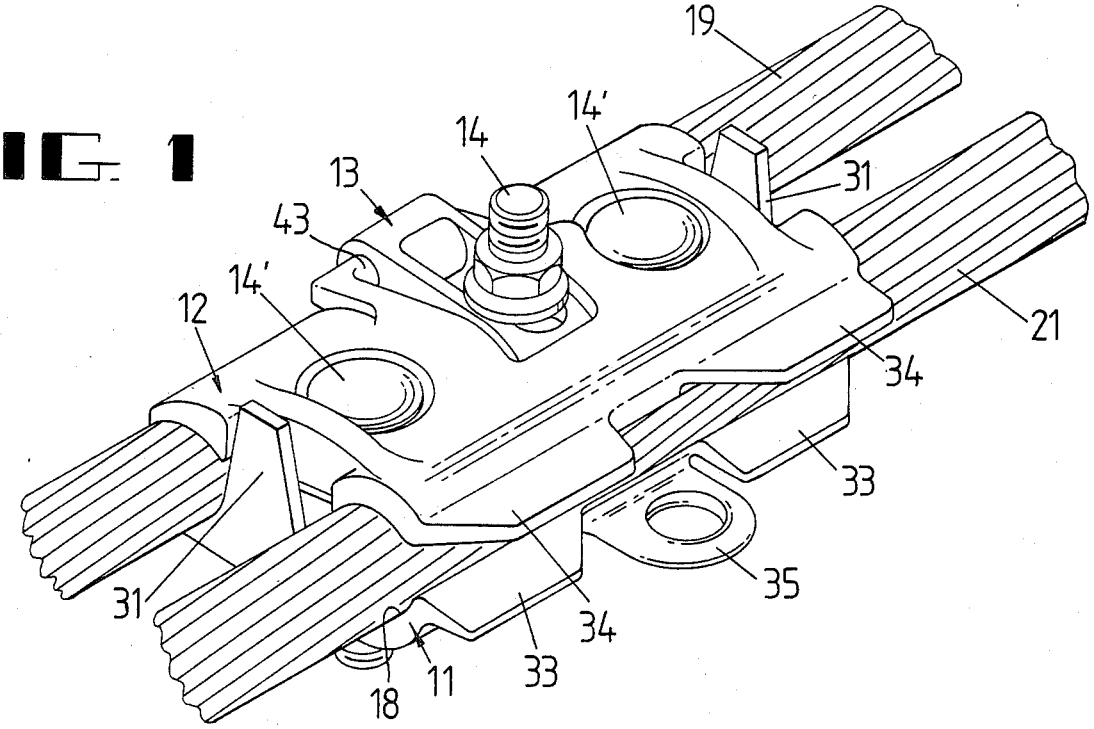
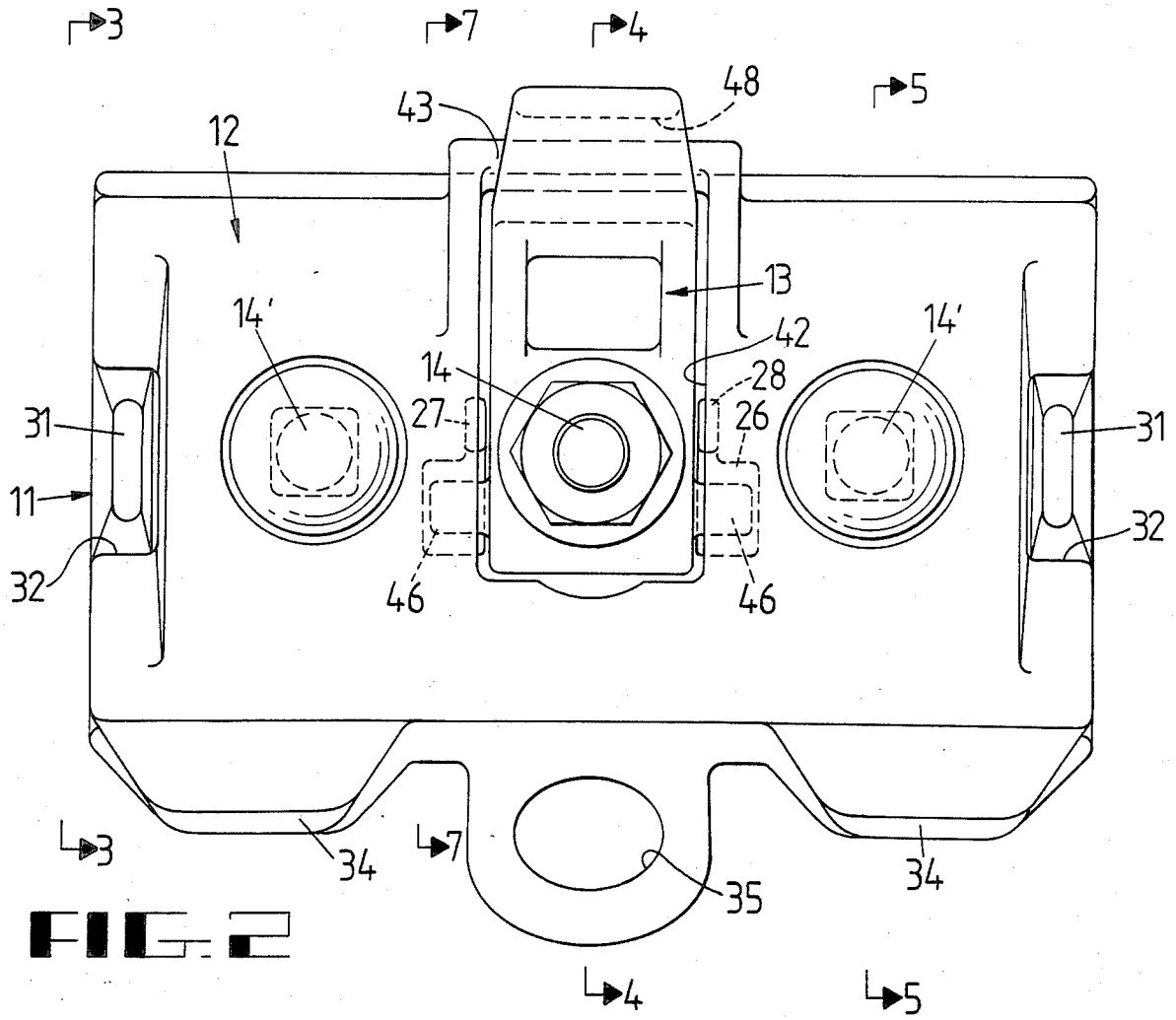
FIG. 2

FIG. 5
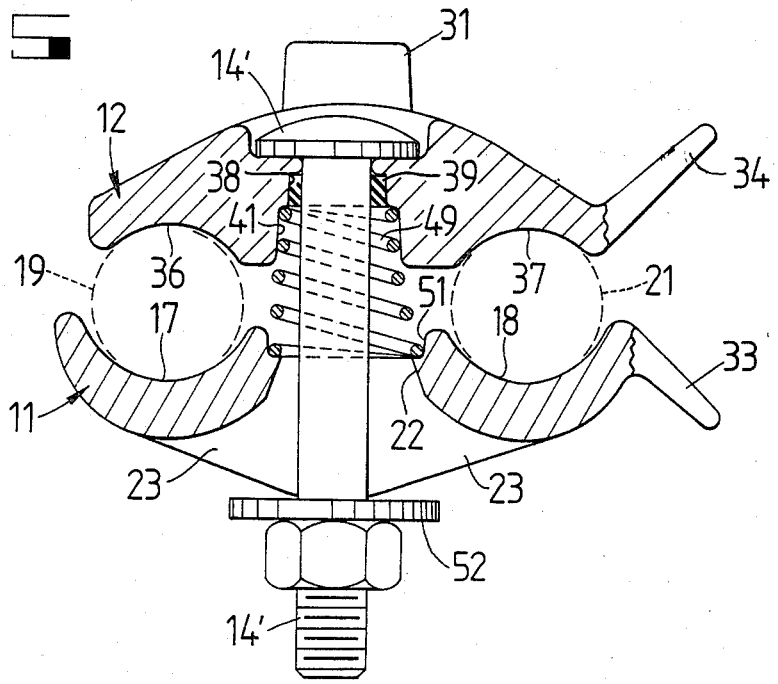
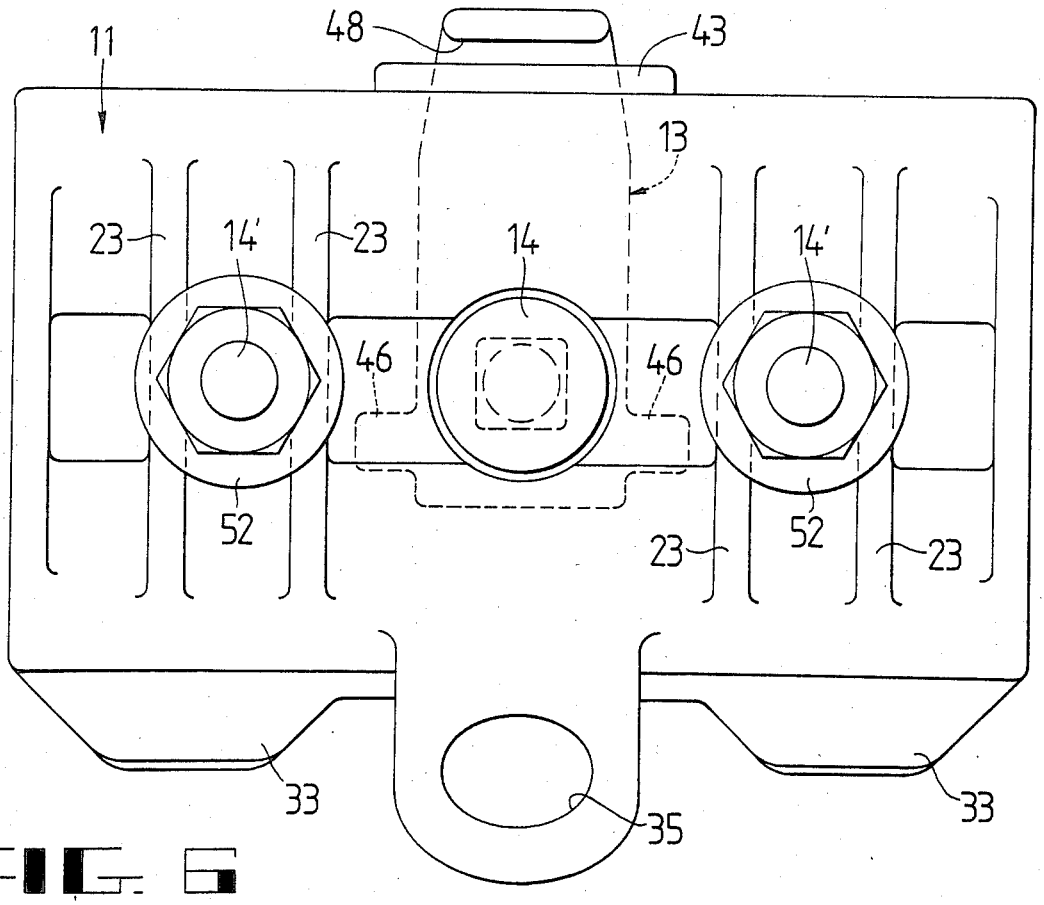
FIG. 6

TAP CONNECTOR

FIELD OF THE INVENTION

The present invention relates to the field of electrical transmission lines and more particularly to a connector for such lines. In particular the present invention may be described as a tap or hot line jumper which is usable with energized transmission lines.

BACKGROUND OF THE INVENTION

Numerous variations in tap connectors have been employed, as are exemplified in U.S. Pat. Nos. 2,272,630 and 3,132,914. Oftentimes, the lineman attempting to utilize the known connector must disassemble the connector to fit it to the lines. In as much as this task is usually performed while wearing insulated gloves, it is not uncommon for the bolts or fasteners of the connector to be dropped from the lineman's perch adjacent the transmission lines. Often as not the lineman chooses to start over with a connector having the proper number of fasteners and discards the connector from which the fastener was lost. Secondly, as noted in U.S. Pat. No. 3,132,914, some prior art connectors do not ensure that the tap line will not become unfastened while the lineman is manipulating the clamp on the energized main line.

SUMMARY OF THE INVENTION

It is the object of the present invention to provide a tap connector which can connect a tap line and energized main line without disassembly.

Another object of the invention is to provide such a connector in which the tap or main line, which is not energized, can be positively secured prior to connection to the energized main line.

These and other objects are advantageously accomplished by my invention which has three main structural components which are connected by a plurality of fasteners, such as bolts and nuts with appropriate washers. Once the invention is assembled, the ends of the bolts are deformed or peened to prevent removal of the nuts. The three structural components include a body member which has formed therein a pair of elongated parallel grooves in which the tap line and the main line are retained. A separate cap member secures the tap and main within the retainer grooves. A keeper is provided to secure the tap in one groove prior to inserting the main line between the body member and cap member. The cap member and body member are biased against relative movement therebetween to facilitate insertion or entrapment of the main line in the connector.

BRIEF DESCRIPTION OF THE DRAWINGS

Apparatus embodying features of my invention are illustrated in the accompanying figures which form a portion of my invention and wherein:

FIG. 1 is a perspective view of my connector as attached between a main line and a tap line;

FIG. 2 is a plan view of my connector;

FIG. 5 is a sectional view taken along line 5—5 of FIG. 2;

FIG. 6 is a bottom view of my connector; and

DESCRIPTION OF A PREFERRED EMBODIMENT

Figure 3:
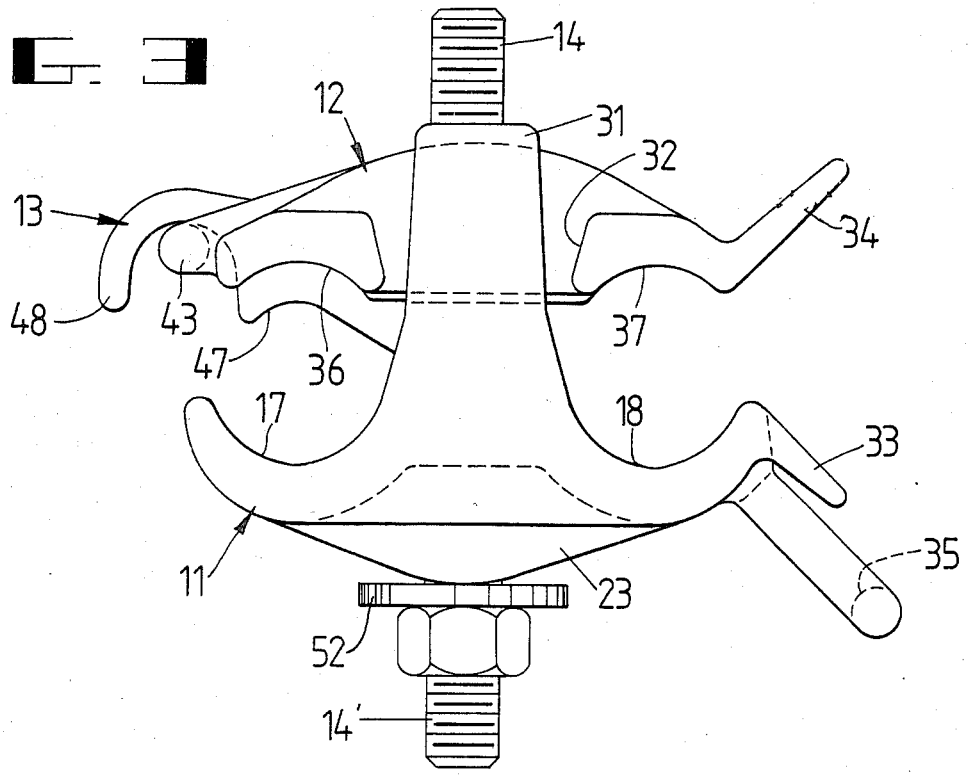
FIG. 3 is an end view taken along line 3—3 of FIG. 2.

Referring to the embodiment shown in FIG. 1, my connector has three main structural elements: a body member 11, a separate cap member 12, and a keeper member 13. These members are connected to each other by a plurality of fasteners 14 which pass through the body member 11 near the centerline thereof. These members are also biased against relative motion therebetween by a plurality of springs which are mounted about the fasteners 14.

Referring to FIGS. 3–6, the body member 11 has formed on the upper surface thereof a pair of elongated parallel retainer grooves 17 and 18 within which a tap line 19 and main line 21 are to be secured. As noted herein above, a series of apertures 22 are located proximal the centerline of the body member 11. The apertures 22', through which the fastener 14 is connected to the cap 12 are oval shaped with their longitudinal axis running perpendicular to the grooves 17 and 18 and are flared from the top surface to the bottom surface of body member 11. The bottom of the body member 11 is provided with a set of rails 23 which run along the sides of the oval shaped apertures 22'. The aperture 22 through the body member 11 which receives the fastener 14 connected through the keeper 13 is not ovaled but rather is recessed to receive the head of the fastener 14.

Figure 7:
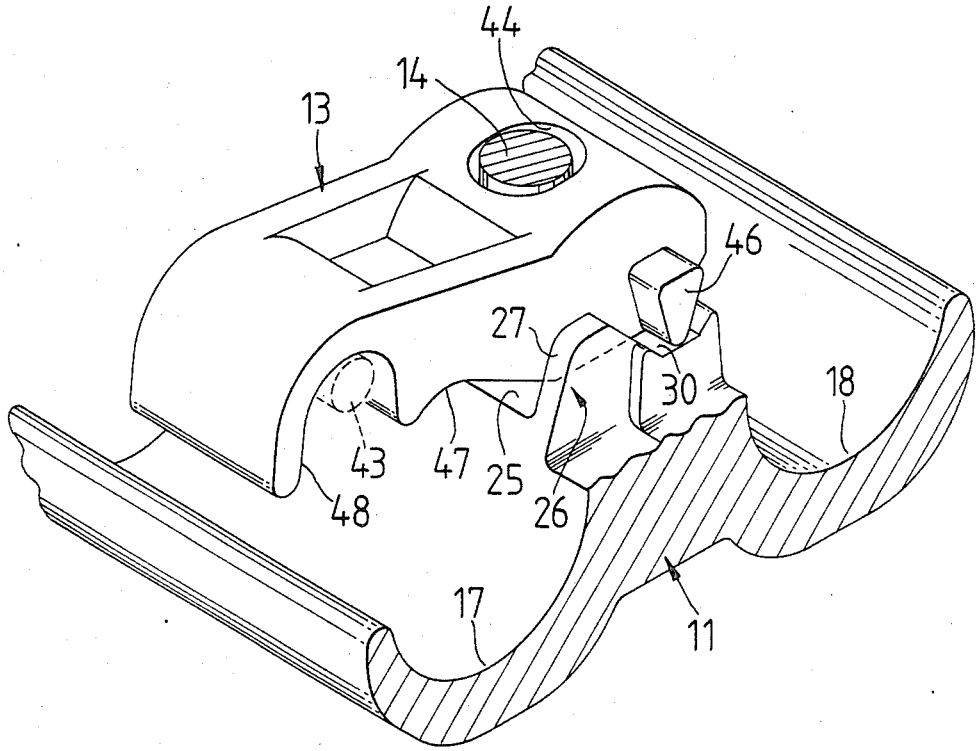
FIG. 7 is a partial perspective view of the keeper and body member.

On the upper surface of the body member 11, intermediate grooves 17 and 18 is a raised seat 26 on which the keeper member 13 rests and through which the aperture 22 extends. As shown in FIG. 7, the raised seat 26 extends parallel to the grooves 17 and 18 and forms a transverse channel 25 between a set of protrusions 27 and 28 which form notches as at 30. A rubber-like grommet 29 is also positioned in the seat 26 and surrounds the fastener 14 to maintain it in place.

At each end of the body member 11, a guide 31 extends normal to the plane of the body member and sits within a bracket 32 formed at each end of the cap member 12 such that the members cannot rotate about the fasteners 14. It should be noted that the guides 31 and brackets 32 could be formed on either the body member 11 or the cap member 12.

A set of line guides 33 flare outwardly from the body member 11 adjacent the groove 18 wherein the main line 21 is to be secured. A like set of guides 34 is cooperatively formed on cap member 12 to facilitate entry of the main line 21 into the connector. A lifting eye 35 is also formed on the body member 11.

The cap member 12 is substantially co-extensive with the body member 11 except for the area through which the keeper member 13 extends. The bottom surface of the cap member 11 has a pair of cooperatively formed grooves 36 and 37 which engage the tap line 19 and main line 21 to secure them in the connector. A set of apertures 38 permit insertion of the fasteners 14'. These apertures 38 like apertures 22 described above receive the head of the fasteners 14'. The fasteners 14' are held in place by rubber grommets 39 which are carried within the apertures 38 in a well 41 formed on the bottom surface of the cap member 12 as shown in FIG. 5.

Figure 4:
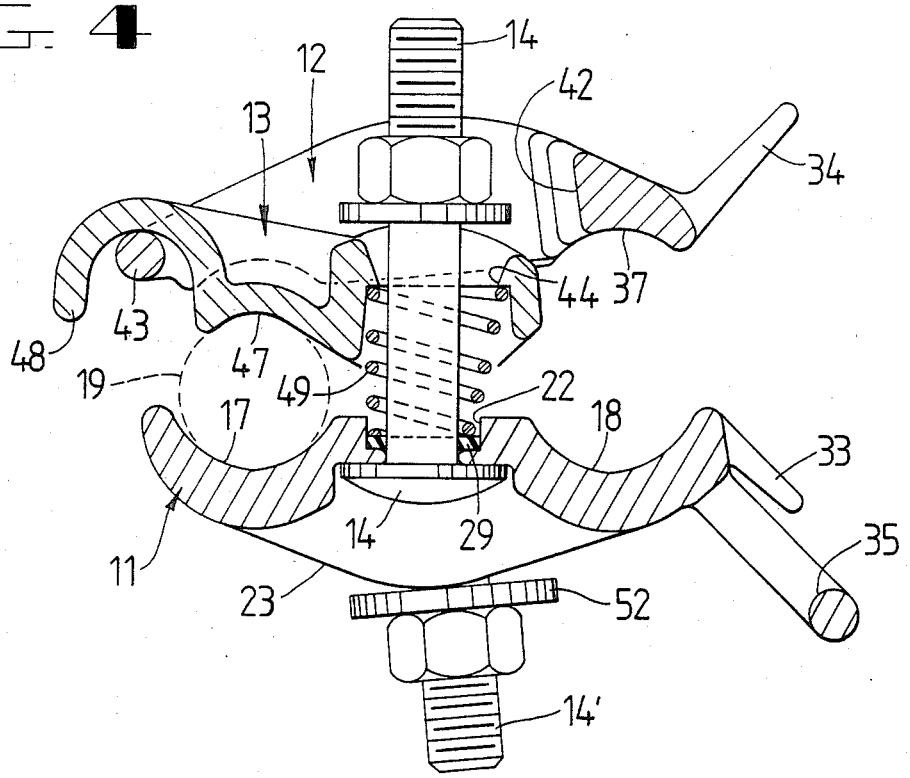
FIG. 4 is a sectional view taken along line 4—4 of FIG. 2.

The cap member 12 has an opening 42 through which the keeper member 13 extends. In the illustrated embodiment, a single keeper element 13 is used, however, it may be desirable to use a double keeper arrangement therefore more than one opening 42 may be required. The opening 42 extends from between the grooves 36 and 37 and across the groove 36 thereby segmenting this groove. In the preferred embodiment, the opening 42 is bounded outwardly of the groove 36 by a bar 43 which is engaged by the keeper member 13 as shown in FIG. 4. The bar 43 may be omitted particularly in applications wherein the body and cap members are biased toward one another.

The keeper member 13 fits into the opening 42 and extends from between the grooves 17 and 18 outwardly across groove 17. The keeper member 13 is a separate casting and includes an opening 44 through which fastener 14 extends. This opening 44 is ovaled and veed as were the apertures 22'. A pair of pivot arms 46 extend outwardly from the keeper member 13 adjacent the opening 44 and are engagable in the notches 30 of seat 26, as shown in FIG. 7. The keeper member 13 may be seated in the transverse channel 25. The underside of keeper member 13 has a groove 47 within which the tap line 19 is engaged to be secured into groove 17. Outwardly of the groove 47 is a down-turned hook portion 48 which engages the bar 43 formed on the cap member 12.

The body member 11, cap member 12, and keeper member 13 are all cast from a high strength aluminum such that the castings have sufficient strength to withstand the forces generated when the fasteners 14 and 14' are torqued to failure. The fasteners 14 and 14' are bolts of galvanized threaded steel or high strength threaded aluminum with rolled threads and compatible washers and nuts. Each bolt is peened at its end after the nut is threaded thereon to prevent the nut from coming off and to prevent the fastener from dropping out of the connector. Each of the grooves may be filled with an inhibitor to prevent contact deterioration.

The body member 11 and cap member 12 are biased relative to each other by stainless steel springs 49 mounted coaxially on the fasteners 14'. The springs 49 are either mounted between the members to hold the members apart, or are mounted outside of the members to urge them together. Likewise, the keeper member 13 is also biased relative to the body member 11 by a spring 49. When the springs 49 are mounted between the castings, as shown in FIG. 5, spring wells 51 and 41 are provided adjacent the apertures 22 and 28, respectively, and when the springs 49 are externally mounted, a retaining washer 52 is used in a manner well understood in the art.

In operation, a tap line 19 is inserted into the groove 17 of the body member 11, either laterally or from the end of the connector. The nut on fastener 14 is tightened thereby urging the keeper member 13 downward into the seat 26, against the top of tap line 19 and into engagement with bar 43 of cap member 12. The pivot arms 46 bear against the seat 26 in a fulcrum-like manner such that the force exerted by tightening fastener 14 is brought to bear against the tap line 19 thereby securing the tap line in the connector and simultaneously entrapping the bar 43 such that the adjacent side of cap member 12 is urged downwardly. Once the tap line 19, which is not energized, is secured, the lineman can easily thrust the connector onto the energized main line 21 with his gloves or by placing a hot stick into the lifting eye 35 and maneuvering the connector onto the main line 21. When the springs 49 are installed between the castings, the side of the connector with the guides 33 and 34 are held open to receive the main line 21. When the springs 49 are externally installed, the guides 33 and 34 align the connector on the main line 21 and the connector closes around the main line 21 as it is forced into the groove 18. The spring loaded cap member 12 is then tightened to secure the main line 21 and to further secure the tap line 19.

Thus it may be seen that my connector is impervious to the loss of fasteners and allows the tap line 19 to be positively secured during the connection of the tap to the main. The described connector is simple to use and is quite efficient, thereby greatly improving the state of the art.

While I have shown my invention in one form, it will be obvious to those skilled in the art that it is not so limited but is susceptible of various changes and modifications without departing from the spirit thereof.

What I claim is:

1. An electrical connector for use with an energized main line and a tap line comprising:

(a) a body member having substantially parallel retaining grooves for receiving said main line and tap line therein;

(b) a cap member having cooperatively formed parallel grooves positioned to hold said main line and tap line in said retaining grooves;

(c) keeper means extending from intermediate said parallel grooves across one of said grooves;

(d) first fastener means extending through said body member intermediate said grooves for urging said keeper means toward said body member such that said keeper means and said body member confine said tap line therebetween in said one groove; and (e) second fastener means for urging said cap member toward said body member for securing said main line and said tap line therebetween.

2. A connector as defined in claim 1 further comprising biasing means for urging said body member and said cap member into a predetermined spacial relation.

3. A connector as defined in claim 1 wherein said keeper means is adapted to engage said tap line to urge said tap line within said one of said retaining grooves and is adapted to engage said cap member along one side thereof outwardly of said one of said grooves such that said cap member is free to pivot about said one side to admit said main line into the other of said retaining grooves.

4. A connector as defined in claim 3 wherein said cap member has at least one transverse opening therethrough extending across said one of said retaining grooves with said keeper means positioned therewithin and with said opening being closed outwardly of said one of said retaining grooves by a bar such that said keeper means is engagable therewith.

5. A connector as defined in claim 1 wherein said cap member has at least one transverse opening therethrough extending across said one of said retaining grooves with said keeper means positioned therewithin and with said opening being closed outwardly of said one of said retaining grooves by a bar such that said keeper means is engaged therewith.

6. A connection as defined in claim 5 wherein said keeper means comprises:

(a) an opening for receiving said first fastening means therethrough;

(b) a pivot portion adjacent said opening for engaging said body member;

(c) a hook portion distal said opening for engaging said bar;

(d) a line engaging groove formed intermediate said hook portion and said opening.

7. A connection as defined in claim 1 wherein said keeper means comprises:

(a) an opening for receiving said first fastening means therethrough;

(b) a pivot portion adjacent said opening for engaging said body member;

(c) a hook portion distal said opening for engaging said bar; and (d) a line engaging groove formed intermediate said hook portion and said opening.

8. A connector as defined in claim 7 wherein said body member has a raised receiver portion, intermediate said retainer grooves, adapted to receive said pivot portion of said keeper.

9. A connector as defined in claim 7 wherein said body member and said cap member have guide elements flaring outwardly adjacent the other of said retaining grooves for directing said main line into said connector.

10. A connector as defined in claim 6 wherein said body member and said cap member have guide elements flaring outwardly adjacent the other of said retaining grooves for directing said main line into said connector.

11. A connector as defined in claim 6 wherein said body member and said keeper means have apertures therethrough for receiving said fastening means with said apertures being oval in shape and having a longitudinal axis perpendicular to said retaining grooves.

12. A connector as defined in claim 1 wherein said first and second fastening means are elongated threaded members engaged by cooperatively threaded nuts with said nuts being irremovable therefrom.

13. A connector as defined in claim 9 wherein said body member has formed thereon, proximal said guide elements, an outwardly extending eye.

14. Apparatus as defined in claim 3 further comprising means to prevent rotation of said body member relative to said cap member about said fasteners.

15. A connector for attaching a tap line to an energized main line, comprising:

(a) a body member having a pair of elongated parallel grooves therein for receiving said tap line and main line;

(b) a cap member movable relative to said body member to secure said tap line and main line with said grooves; and (c) a separate keeper member movable relative to said body member to secure said tap line within one of said grooves and to engage said cap member outwardly of said tap line such that said cap member and said body member may receive said main line within the other of said grooves while said tap line is secured by said keeper.

16. A connector as defined in claim 15 wherein said cap member has at least one transverse opening therethrough extending across said one of said grooves with said keeper member positioned therewithin and with said opening being closed outwardly of said one of said grooves by a bar such that said keeper is engaged therewith.

17. A connector as defined in claim 15 wherein said keeper member comprises:

(a) an opening for receiving said first fastening means therethrough;

(b) a pivot portion adjacent said opening for engaging said body member;

(c) a hook portion distal said opening for engaging said bar; and (d) a line engaging groove formed intermediate said hook portion and said opening.

18. A connector as defined in claim 17 wherein said body member has a raised receiver portion, intermediate said retainer grooves, adapted to receive said pivot portion of said keeper.

19. A connector as defined in claim 15 wherein said body member and said cap member have guide elements flaring outwardly adjacent the other of said retaining grooves for directing said main line into said connector.

20. A connector as defined in claim 19 wherein said body member has formed thereon, proximal said guide elements, an outwardly extending eye.

21. A connector as defined in claim 15 further comprising biasing means for urging said body member and said cap member into a predetermined spacial relation.

22. Apparatus as defined in claim 15 further comprising means to prevent rotation of said body member relative to said cap member about said fasteners.

* * * * *